US010004970B1

(12) United States Patent
Mailander

(10) Patent No.: US 10,004,970 B1
(45) Date of Patent: Jun. 26, 2018

(54) LIFT-ASSIST DEVICE

(71) Applicant: Kizzie Ann Mailander, Chicago, IL (US)

(72) Inventor: Kizzie Ann Mailander, Chicago, IL (US)

( * ) Notice: Subject to any disclaimer, the term of this patent is extended or adjusted under 35 U.S.C. 154(b) by 71 days.

(21) Appl. No.: 14/986,518

(22) Filed: Dec. 31, 2015

Related U.S. Application Data

(60) Provisional application No. 62/098,901, filed on Dec. 31, 2014.

(51) Int. Cl.
*A63B 21/072* (2006.01)
*A63B 71/00* (2006.01)
*A63B 21/00* (2006.01)

(52) U.S. Cl.
CPC ..... *A63B 71/0054* (2013.01); *A63B 21/0724* (2013.01); *A63B 21/4035* (2015.10)

(58) Field of Classification Search
CPC ..... A63B 71/0054; A63B 21/4035; A63B 21/0724
USPC ..... 482/39, 106–108, 139
See application file for complete search history.

(56) References Cited

U.S. PATENT DOCUMENTS 3,679,107 A * 7/1972 Perrine ..... A45F 3/14 224/201
4,213,605 A * 7/1980 McPeak ..... A63B 21/072 224/201
4,463,977 A * 8/1984 Wyatt ..... B65G 7/12 294/26
4,484,740 A * 11/1984 Green ..... A63B 23/03508 482/105
4,743,017 A * 5/1988 Jaeger ..... A63B 21/075 482/108
5,211,615 A * 5/1993 Sides ..... A63B 21/065 482/105
5,573,484 A * 11/1996 Carpenter ..... A63B 21/00181 482/108
5,957,818 A * 9/1999 Betournay ..... A63B 21/065 482/105
6,183,400 B1 * 2/2001 Pope ..... A63B 21/4019 16/422
6,247,739 B1 * 6/2001 Lyon ..... A45F 5/1026 294/137
6,371,893 B1 * 4/2002 Redden ..... A63B 21/065 482/104
6,715,728 B2 * 4/2004 Nielsen ..... A63B 21/4035 224/268
6,849,036 B2 * 2/2005 Forslid ..... A63B 21/4021 482/139
7,213,851 B2 * 5/2007 Mann ..... A47J 36/16 294/131
7,261,677 B2 * 8/2007 Anghman ..... A63B 21/065 482/105
7,674,214 B2 3/2010 Marethouse et al.
(Continued)

*Primary Examiner* — Andrew S Lo
(74) *Attorney, Agent, or Firm* — Underoowd & Associates, LLC

(57) ABSTRACT

Stabilizing lift-assist devices include a framework having a graspable handle and at least two V-shaped framework members that provide kinematic constraints for a weight bar received therein. Such lift-assist devices can be used for stabilizing a weight bar during exercise to reduce the possibility of injury from slippage or body positioning that leads to hyperextension of various physiologies.

1 Claim, 9 Drawing Sheets

(56) References Cited

U.S. PATENT DOCUMENTS

| | | | | |
|---|---|---|---|---|
| 7,789,814 | B1 * | 9/2010 | Xu | A63B 21/0728 482/107 |
| 7,963,891 | B1 * | 6/2011 | Zeaman | A63B 21/4019 482/104 |
| 8,267,841 | B1 * | 9/2012 | Allison | A63B 21/06 482/106 |
| 8,671,530 | B2 * | 3/2014 | Ciminski | A63B 21/0728 24/273 |
| D725,722 | S * | 3/2015 | Conaway | D21/679 |
| 2004/0185989 | A1 * | 9/2004 | Emick | A63B 21/4035 482/106 |
| 2005/0085352 | A1 * | 4/2005 | Baxter | A63B 21/0724 482/100 |
| 2009/0088305 | A1 * | 4/2009 | Marethouse | A63B 23/0405 482/139 |
| 2009/0203508 | A1 * | 8/2009 | Hauser | A63B 1/00 482/139 |
| 2009/0325769 | A1 * | 12/2009 | Miskel | A63B 21/0728 482/107 |
| 2010/0137113 | A1 | 6/2010 | Marethouse et al. | |
| 2011/0111929 | A1 * | 5/2011 | Allison | A63B 21/072 482/108 |
| 2012/0227221 | A1 * | 9/2012 | Whitaker | A61M 39/1011 24/459 |
| 2013/0303348 | A1 * | 11/2013 | Cardin | A63B 21/0724 482/139 |
| 2014/0287889 | A1 * | 9/2014 | Grace | A63B 21/0728 482/106 |
| 2015/0306446 | A1 * | 10/2015 | Spainhower | A63B 21/0726 482/106 |

* cited by examiner

LIFT-ASSIST DEVICE

CROSS REFERENCE TO RELATED APPLICATIONS

This application claims priority to and the benefit under 35 USC § 119(e) of U.S. Provisional Patent Application No. 62/098,901, filed on 31 Dec. 2014, the contents of which are incorporated by reference in their entirety as if fully set forth herein.

TECHNICAL FIELD

This disclosure relates to handles for lifting objects that place hands and arms in a proper biomechanical position to reduce the likelihood of injury. In particular, this disclosure relates to a graspable lift-assist device configured to provide ergonomic positioning and stability when lifting objects such as weight bars, and in particular, barbells.

BACKGROUND

Weight bars, also referred to as barbells or so-called 'body bars' are devices used in various types of exercise routines that include an elongate bar having a gripping surface and two ends onto which weights can be placed. Weight machines having slidable captive bars that ride along rails are also used for weight lifting exercises. Weightlifters are particularly familiar with weight bars as they are used in many exercises; e.g., squats, bench press, bicep curls, etc.

Generally, weight bars are formed of steel to accommodate weights placed at opposite ends of the bar and prevent bowing. The middle portion of a weight bar usually includes a textured surface for enhanced gripping or, in some cases, a deformed section to provide a more ergonomic grip that reduces torsion between the hand and forearm.

SUMMARY

In general, lift-assist devices are disclosed. In one exemplary embodiment, a lift-assist device includes a framework having a graspable handle, and at least two V-shaped framework members that provide kinematic constraint for a weight bar received therein. The kinematic constraints provide stable engagement with the lift-assist device. Furthermore, a lift-assist device as described herein provides gripping surfaces that are displaced from the bar itself, which can allow a weight lifter to place their hands and arms in an ergonomic, proper biomechanical position so as to reduce the likelihood of injury to shoulders, arms, the back, and other physiologies. Lift assist devices of the type described herein can provide the ability to perform certain exercises with reduced likelihood of injury due to improper body form, hyperextension of muscles and ligaments, weight bar slippage, and loss of balance.

In one embodiment, the lift-assist device further includes a framework pigtail member that provides a surface for receiving a fastening member, which also engages the weight bar for further stabilization.

In one exemplary aspect, a stabilizing lift-assist device is disclosed. The stabilizing lift-assist device includes a handle member, a bar-clamp member and an integral armature spanning therebetween. The bar-clamp member is configured to reversibly lock about a weight bar handle.

In one embodiment, the bar-clamp member includes an upper-half portion integral to the armature, and a lower-half portion hingedly coupled to the armature. In a related embodiment, the bar-clamp member further includes a locking mechanism configured to reversibly lock the upper-half portion and the lower-half portion into a substantially confronting relationship about the weight bar handle. In a further related embodiment, the locking mechanism is a draw latch. In yet another related embodiment, the lift-assist device further includes a series of latch recesses, each configured to receive a latch portion of the draw latch. In various embodiments, the stabilizing lift-assist device further includes an anti-slip member disposed on an inner surface of the latch portion that is configured to confront a portion of the weight bar handle when the bar-clamp member is in a closed configuration.

In one embodiment, the bar-clamp member is configured to reversibly lock about a weight bar handle having a first handle diameter and a second, different weight bar handle having a second, different handle diameter. In a related embodiment, the bar-clamp member is configured to exert an approximately equal amount of clamping force when applied about the first handle and, separately, the second handle.

In one embodiment, the armature further includes padding configured to be disposed between the armature and the shoulders of a user using the lift-assist device.

In one embodiment, the length between the center of the bar-clamp member and the handle is between about 4 inches and about 8 inches.

In one embodiment, the length between the center of the bar-clamp member and the handle is about six inches.

In one embodiment, the handle member includes a graspable portion having a longitudinal axis, and wherein the graspable portion is configured within the handle member to rotate about the longitudinal axis.

In one exemplary aspect, a handle for controlling a weight bar is disclosed. The handle includes a clamping mechanism for reversibly securing the handle onto the weight bar and a graspable structural component for controlling the weight bar.

In one embodiment, the graspable structural component for controlling the weight bar is a graspable handle disposed from about four inches to about 8 inches from the weight bar.

In one embodiment, the handle further includes an anti-slip member for reducing the likelihood of the weight bar slipping through the clamping means.

In one exemplary aspect, a method for reducing the likelihood of injury from lifting weights is disclosed. The method includes providing a handle member and a bar-clamp member spanned by an armature, wherein the bar-clamp member is configured to clamp about a weight bar.

In one embodiment, the method further includes disposing an anti-slip member on an inside surface of the bar-clamp member. In a related embodiment, the method further includes providing a bar-clamp locking mechanism configured to reversibly lockingly secure the bar-clamp member in a closed configuration. In another related embodiment, reducing the likelihood of injury is provided by forming the armature of a length suitable to effectively shift a grippable portion of the weight bar away from the weight bar by at least eight inches.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings in which like references indicate similar elements, the figures are not necessarily to scale, the Cartesian coordinate system illustrated in each figure is consistent, and in which.

DETAILED DESCRIPTION OF ILLUSTRATIVE EMBODIMENTS

FIGS. 1-7 illustrate a stabilizing lift-assist device (hereinafter lift-assist device') 100 according to one embodiment. In FIGS. 1-7, a weight bar 1 is shown for illustrative purposes only and is not part of the lift-assist device 100.

Figure 1:
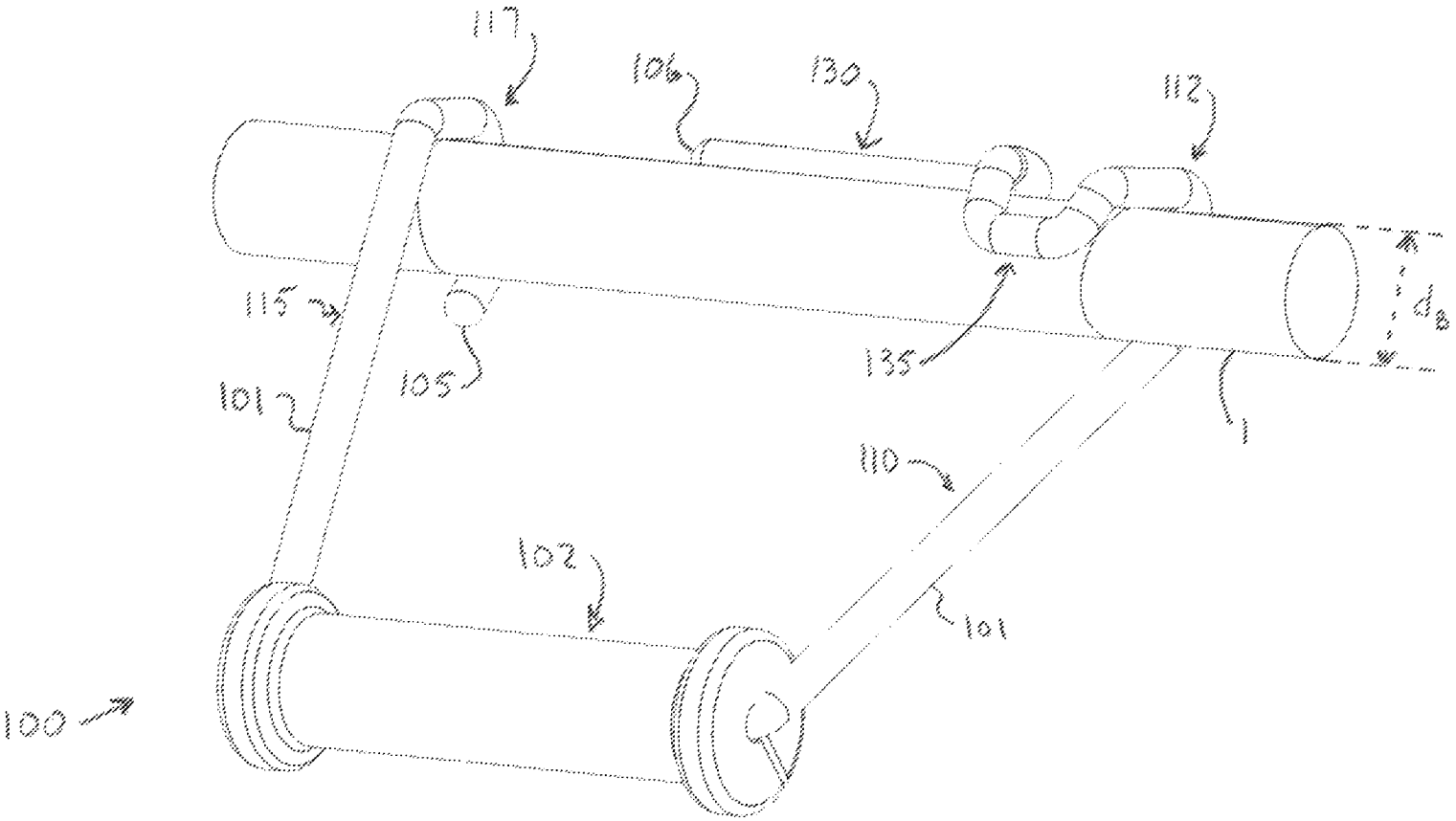
FIG. 1 is a perspective view of a lift assist device 100 according to one embodiment.
Figure 2:
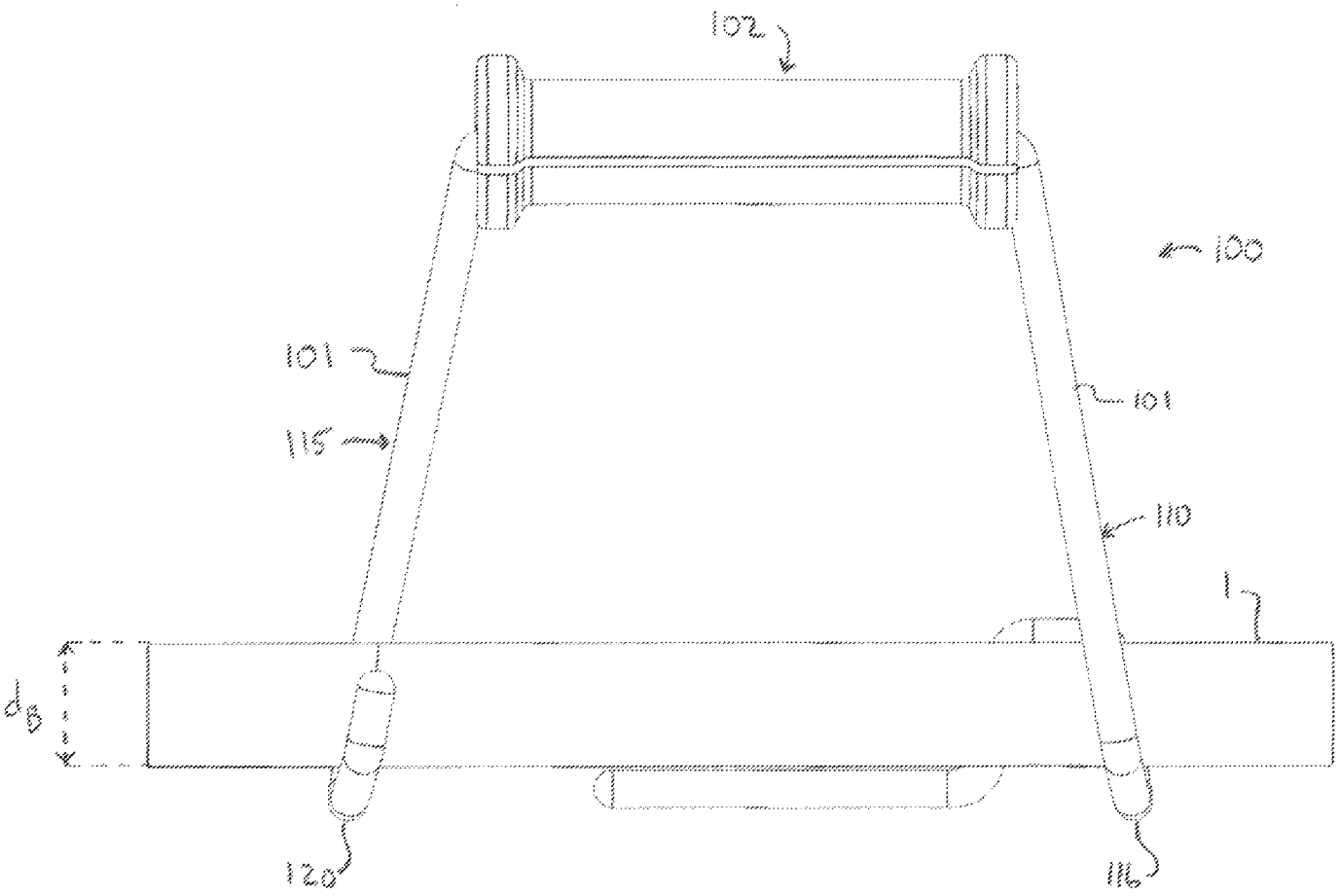
FIG. 2 is a bottom view of the lift assist device 100 shown in FIG. 1.

Referring first to FIG. 1, the lift-assist device 100 is illustrated in a perspective view in an operational configuration with weight bar 1 according to one embodiment. In this embodiment, the lift-assist device 100 includes frame member 101 which has various formed features as shown and described in greater detail below. In this embodiment, the frame member 101 is a resilient, continuous rod extending from first end portion 105 to second end portion 106. Exemplary rod materials include, without limitation: metals and metal alloys such as steel, iron, aluminum, and others; carbon fiber materials, and resilient polymeric materials, for example, high-strength polypropylene.

In this embodiment, the lift-assist device 100 includes a graspable, centrally-disposed handle member 102 as illustrated. In this embodiment, the handle member 102 is configured such that it can rotate about the portion of the frame member 101 about which it is disposed while minimizing lateral shifting. The handle member 102 can include features to enhance gripability, such as indents or detents, coverings, anti-slip compounds or other features. Similarly, in this example, the handle member 102 includes raised portions on opposite terminal ends as illustrated for the purpose of keeping a user's hand centrally-disposed and to prevent slippage.

In general, lift-assist device 100 can be engaged with weight bar 1 so as to provide a stabilized, ergonomic gripping platform. In this embodiment, the lift-assist device 100 includes first (110) and second (115) arm members configured at an offset angle θ (see, e.g., FIGS. 3 and 6) such when the list-assist device 100 is operably engaged with a weight bar 1, e.g., as shown in FIG. 1, each of the arms 110, 115 extends over bar 1 on opposite sides as illustrated.

In this embodiment, each of the first (110) and second (115) arms includes a substantially V-shaped support framework 112, 117, respectively as illustrated in FIGS. 1-7. In this embodiment, the V-shaped framework 112, 117 is configured such that, when the lift-assist device 100 is engaged with weight bar 1 in an operational configuration as illustrated in FIGS. 1-7, the weight bar 1 engages each V-shaped framework in only two places. For example, referring to FIGS. 3 and 6 in particular, V-shaped framework 117 (FIG. 3) engages weight bar 1 at contact points 118 and 119 as illustrated, and V-shaped framework 112 (FIG. 6) similarly engages weight bar 1 at contact points 113 and 114 as illustrated.

Figure 3:
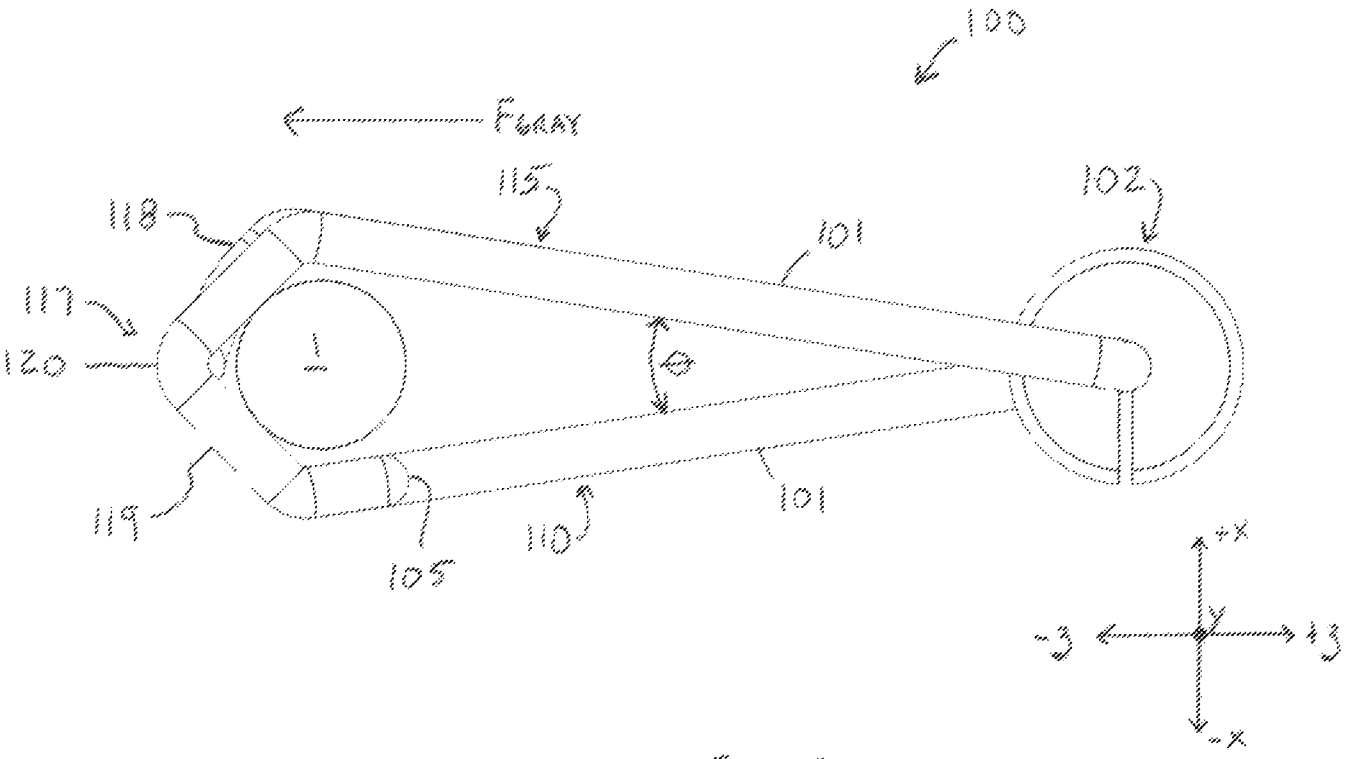
FIG. 3 is a left-side view of the lift assist device 100 shown in FIG. 1.
Figure 6:
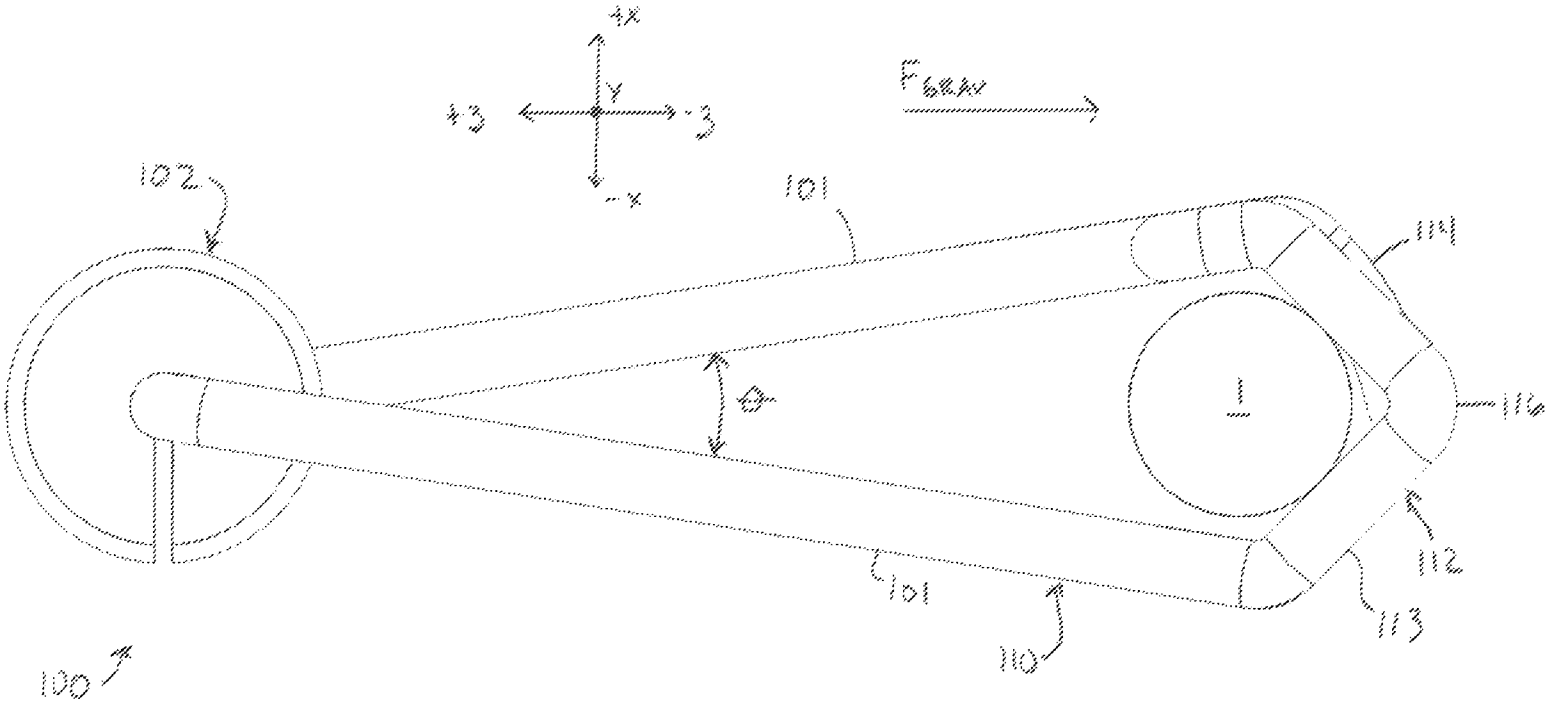
FIG. 6 is a right-side view of the lift assist device shown in FIG. 1.

Referring to the illustrations of FIGS. 2, 3, 5 and 6 in particular, the configuration of V-shaped frameworks 112 and 117 provide stabilization of weight bar 1 by minimizing the number of contact points therewith and provides a type of kinematic constraint when the lift-assist device 100 is used to support weight bar 1 in the z dimension, in this example, against the force of gravity $F_{GRAV}$. In this embodiment, the positions of troughs 116, 120 of each V-shaped framework 112, 117, respectively, establishes a straight line to which weight bar 1 naturally aligns when resting within the V-shaped frameworks as illustrated. In this example, because each V-shaped framework provides only two constraining contact points, shifting of the weight bar 1 is minimized in the positive and negative x dimension direction (FIGS. 3 and 6). In this embodiment, the V-shaped frameworks 112, 117 are configured such that the depth of each "V" is larger than the diameter $d_B$ of weight bar 1, which reduces the likelihood of the weight bar 1 inadvertently falling out of a V-shaped framework during use and provides that the device can accommodate a range of weight bar diameters.

Figure 7:
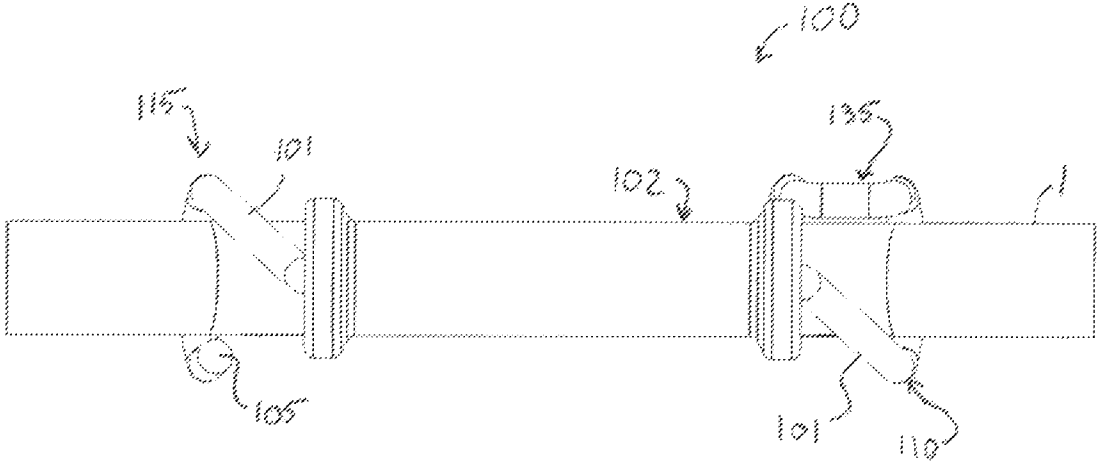
FIG. 7 is a rear view of the lift assist device shown in FIG. 1.

Referring now to FIG. 7 in particular, in this embodiment, the angled configuration of arms 110, 115 further reduce the likelihood of the weight bar 1 falling out of the lift-assist device 100 during use. As described above, the first (110) and second (115) arms are set at an angle θ such that each arm extends over opposite sides of weight bar 1. This configuration reduces the likelihood of weight bar 1 rolling out of the lift-assist device 100 compared to a configuration where both arms 110, 115 extend to the same side of weight bar 1 (not shown in the figures).

Figure 4:
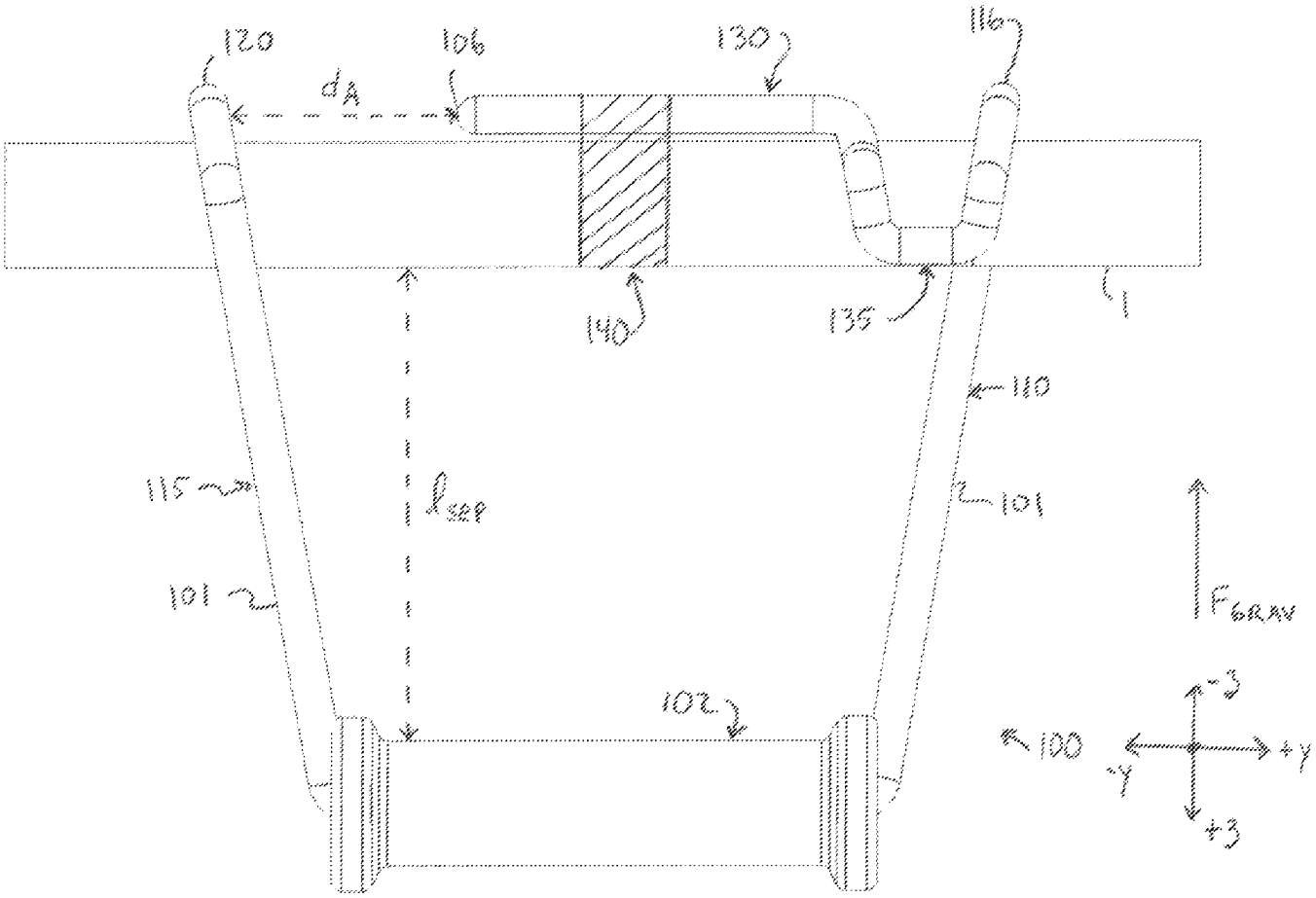
FIG. 4 is a top view of the lift assist device shown in FIG. 1.
Figure 5:
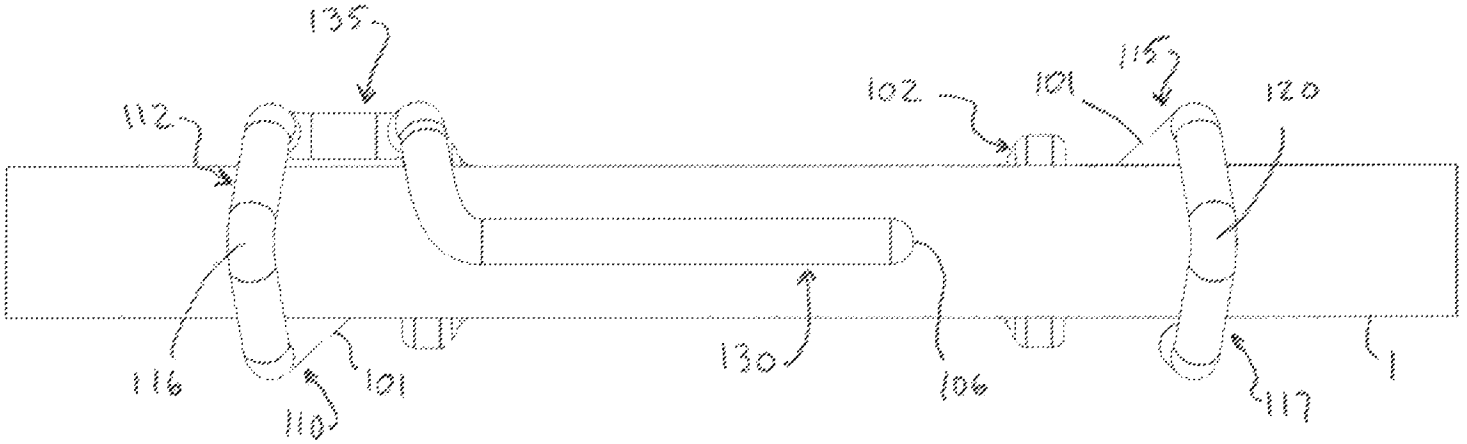
FIG. 5 is a front view of the lift assist device shown in FIG. 1.

Referring now to FIG. 4, in this embodiment, lift-assist device 100 includes a pigtail member 130 which extends from V-shaped framework member 112 through U-shaped member 135 as illustrated. In this embodiment, pigtail member 130 is configured to run parallel to, and slightly displaced from the line defined by the position of troughs 116, 120 such that it extends parallel with, and slightly offset from weight bar 1 as illustrated. In this embodiment, the purpose of pigtail member 130 is to provide a surface for receiving one or more fastening members 140 capable of extending around weight bar 1 as shown. In this example, fastening member 140 is a length of hook-and-loop-type fastening material; however, any other alternative fastening material can be used as desired.

In this embodiment, the pigtail member 130, in cooperation with fastening member 140 reduces the likelihood of weight bar roll and provides stabilization in the positive and negative y dimension directions by reducing the likelihood of shifting along that axis. In this particular embodiment, frame member 101 is formed from a substantially rigid material, such that the pigtail member 130 does not flex when coupling the pigtail member 130 to weight bar 1 via fastening member 140. Such a configuration can maintain the kinematic constraints provided by the V-shaped frameworks 112, 117, which leads to maximum stability of weight bar 1 within the lift-assist device 100. Furthermore, fastening member 140 urges weight bar 1 into the groove of the V-shaped frameworks 112, 117, against the kinematic constraints, e.g., contact points 113, 114, 118 and 119.

Thus, in this embodiment, stabilization of weight bar 1 within lift-assist device 100 is cooperatively engendered by an urging force against contact points 113, 114, 118, and 119 within the V-shaped framework members 112, 117 (x dimension), a fastening member 140 engaged with both the weight bar 1 and pigtail member 130 (y dimension) and the force of gravity which urges weight bar 1 toward the troughs 116, 120 of the V-shaped members 110, 115 respectively (z dimension) in this example.

Lift-assist device 100 can be used to provide stabilization for a variety of weight-lifting exercises. Lift-assist device 100 also provides the ability to focus on target muscle groups for a particular exercise while expending less muscle strength gripping and stabilizing a weight bar. For example, when performing squat-lifts using a traditional weight bar, the practitioner typically attempts to focus on balance and form; however, some amount of energy is expended gripping and stabilizing the weight bar, in particular, controlling the "roll" of the bar across the hands and shoulders. Lift-assist device 100 allows the practitioner to, for example, rest the handle member 102 in the "V" between the thumb and index finger and allow frame member 101 to carry and stabilize the load. Because handle member 102 rotates about frame member 101, the practitioner need not change grip or account for the roll of the weight bar when performing such exercises.

Similarly, lift-assist device 100 can provide a more ergonomic positioning of the hands and arms for performing certain exercises. For example, some practitioners perform squats with a weight bar positioned across the rear upper shoulders, e.g., across the upper scapulae. Holding and stabilizing a heavy weight bar in this position can result in hyperextension or overexertion of the ligaments and muscle groups in the shoulders, arms, and back which can lead to injury. Referring to FIG. 4 in particular, lift-assist device 100 provides a separation $l_{SEP}$ between weight bar 1 and the handle member 102 such that the effective gripping surface of weight bar 1 is shifted away from weight bar 1. Thus, keeping with the example of squat exercises, the gripping surface of the weight bar is effectively shifted a distance $l_{SEP}$ which, depending on the distance $l_{SEP}$ chosen, can place the practitioner's hands in a more forward, ergonomic position that is less likely to cause musculoskeletal injury.

Referring to FIGS. 4 and 7, in this embodiment, lift-assist device 100 can be engaged and disengaged with weight bar 1 by a simple advance-and-turn technique. For example, to engage lift-assist device 100 with weight bar 1 into an operable configuration (as in FIG. 1), the practitioner can advance the frame member 101 such that weight bar 1 passes through aperture $d_A$ defined between end portion 106 and trough 120 a distance to clear U-shaped member 135. The practitioner can then rotate and slightly retreat the lift-assist device 100 in a direction that engages weight bar 1 with the V-shaped frameworks 112, 117 as discussed. The practitioner can optionally apply fastening member 140 to pigtail member 130 for additional stabilization as described. Lift-assist device 100 can be disengaged from weight bar 1 by performing the aforementioned steps in reverse sequence. As one of skill in the art of sports training, medicine, or therapy will surely recognize, practitioners can utilize two lift-assist devices 100 concurrently, i.e., with one in each hand during exercise.

In general, lift-assist device 100 can be used when performing a variety of lifting movements or actions. For example, as described above, lift-assist device 100 can be used during squat-type exercises which allow the practitioner's hands to be placed anteriorly, in a more forward, biomechanically-friendly position. In another example, lift-assist device 100 can aid in "dead-lift" like lifting activities as, e.g., handle member 102 can be modified or molded to provide a more ergonomic hand grip than a straight weight bar. Furthermore, yet, because lift-assist device 100 is capable of accommodating a variety of bar sizes, objects having relatively thin bars—such as buckets—can be carried easily and reduce biomechanical stress that would otherwise be imposed on the fingers.

As with most exercise equipment, safety is a paramount consideration. For this reason, in this embodiment, lift-assist device 100 is configured such that pigtail member 130 points toward second arm 115 so as not to jut out and potentially create a snagging hazard. Similarly, in this embodiment, all surfaces of the lift-assist device are smooth and rounded to reduce the likelihood of snagging on clothes, equipment, or other items which may present a hazard.

Figure 11:
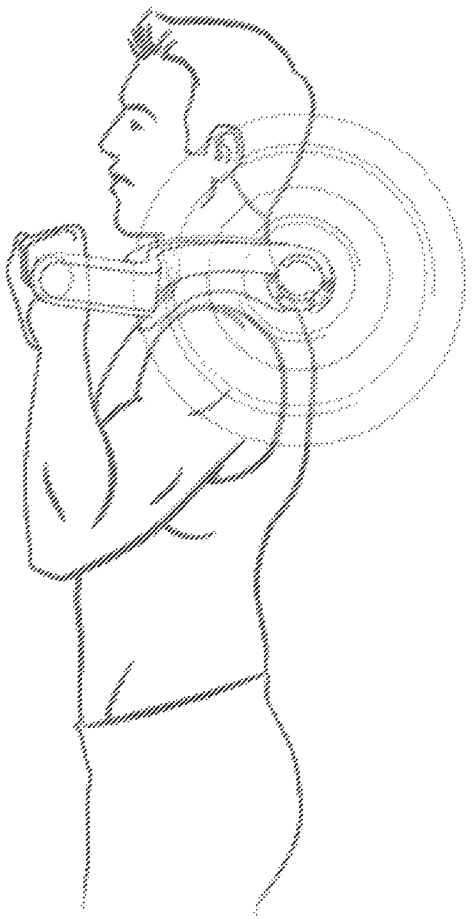
FIG. 11 illustrates the lift-assist device of FIG. 8 in use by a weight-lifting practitioner.
Figure 8:
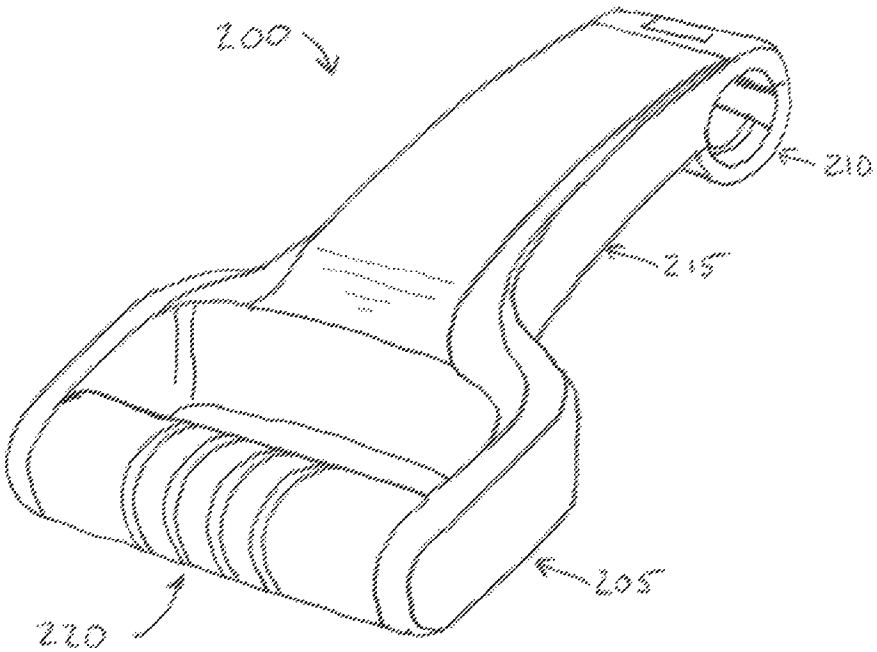
FIG. 8 is a perspective view of a lift-assist device according to one embodiment.
Figure 12:
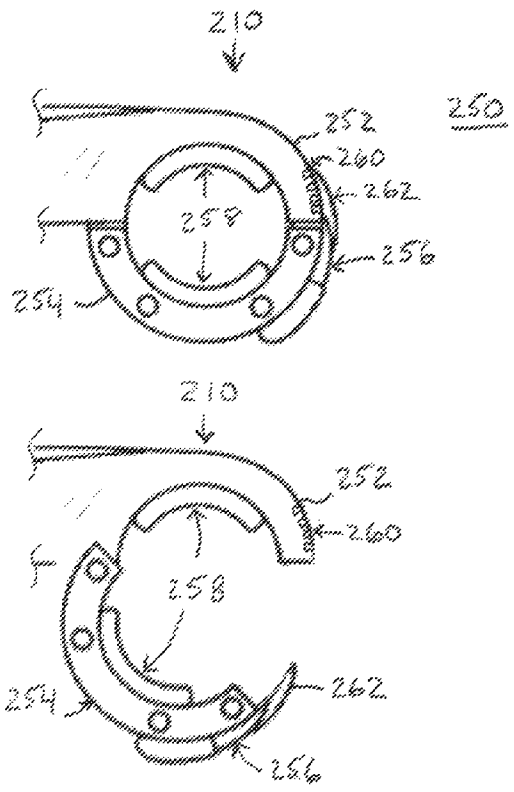
FIG. 12 shows a magnified view of a portion of FIG. 10.
Figure 9:
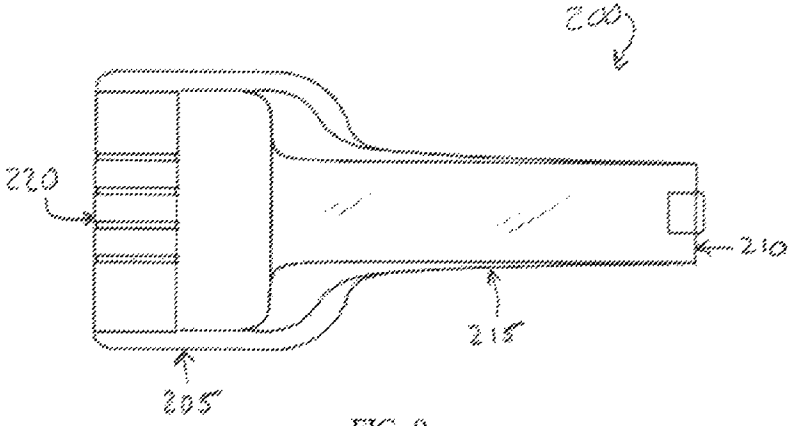
FIG. 9 is a top-view of the lift-assist device of FIG. 8.
Figure 10:
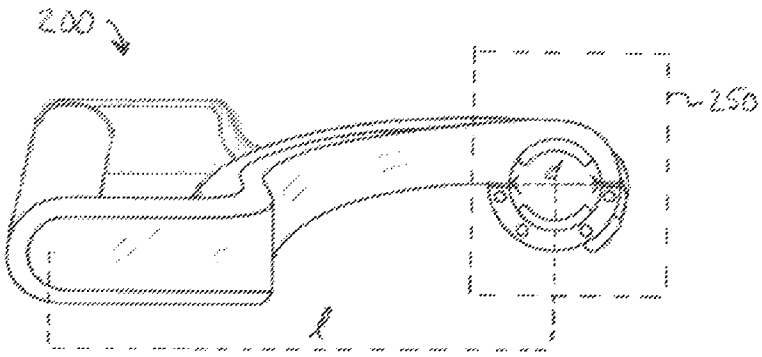
FIG. 10 is a side-view of the lift-assist device of FIG. 8.

Referring now to FIGS. 8-12, a lift-assist device 200 is illustrated according to a second embodiment, wherein FIG. 8 illustrates the lift-assist device 200 in a perspective view; FIG. 9 is a top view thereof; FIG. 10 is a side view thereof; FIG. 11 illustrates the lift-assist device 200 in practice; and FIG. 12 is a magnified view of section 250 of FIG. 10. In this embodiment, the lift-assist device 200 includes a handle member 205 itself having a gripping member 220, and a bar-clamp member 210 spanned by armature 215. Referring to FIGS. 10 and 12 in particular, in this embodiment, approximately one-half of the bar-clamp member 210 is integral to armature 215; the other approximately one-half of the bar-clamp member 210 is hingedly coupled to armature 215 to allow the bar-clamp member 210 to shift between closed (top illustration in FIG. 12) and open (bottom illustration in FIG. 12) configurations. For example, referring to FIG. 12, which is a magnified view of section 250 of FIG. 10, in this embodiment, the bar-clamp member 210 is configured to reversibly lock about a weight bar handle and includes a top clamp member 252 integral to armature 215 and a bottom clamp member 254 hingedly-coupled to armature 215 as illustrated.

In general, bar-clamp member 210 provides for clamping the lift-assist device 200 to a weight bar, and handle 205 and armature 215 cooperatively allow control of a weight bar during use, e.g., during exercise.

In this embodiment, the bar-clamp member 210 is configured to clamp around the handle portion of a weight bar, and reversibly lock the top clamp member 252 and the bottom clamp member 254 into a substantially confronting relationship about said weight bar handle. In this and other embodiments, the inner diameter d of the bar-clamp member 210 can be customized to fit a single-sized bar or, alternatively, to fit a range of bar handle sizes. In this embodiment, the bar-clamp member 210 includes at least one anti-slip member 258 configured to reduce the likelihood of a weight bar from shifting through the bar-clamp member 210 when the bar-clamp member 210 is in the closed configuration. Exemplary anti-slip member materials include, without limitation, rubbers, plastics, neoprene or other materials. In a preferred embodiment, the inner diameter d of the bar-clamp member 210 and the thickness of the anti-slip member can be chosen such that when the bar-clamp member 210 is closed around the handle of a weight bar, the at least one anti-slip member is at least slightly compressed to provide increased anti-slip performance.

In this embodiment, the bar-clamp member 210 includes a locking mechanism 256 configured to releasably secure the bottom clamp member 254 to the top clamp member 252 when the bar-clamp member 210 is in a closed configuration about a weight bar handle. One exemplary, non-limiting type of locking mechanism 256 is a draw latch, which is the type of locking mechanism 256 illustrated in, e.g., FIGS. 10 and 12. In this embodiment, the locking mechanism includes an adjustable draw latch wherein latch component 262 is configured to engage one of a series of latch recesses 260 disposed on the top clamp member 252. The lever portion 256 of the adjustable draw latch is configured to allow the latch component 262 to be inserted into the one of the series of latch recesses 260 and draw the top (252) and bottom (254) clamp members together into a releasably-locked configuration using mechanical leverage of the lever portion 256. In this way, the clamp member 210 is capable of clamping on to a variety of weight bars of differing handle diameter. In this and other embodiments, the bar-clamp member 210 is configured to exert an approximately equal amount of clamping force when applied about a first handle having a first longitudinal diameter and, separately, a second handle having a second, different longitudinal diameter.

Referring to FIG. 10 in particular, the length l between the center (focus) of the clamp member 210 and the center of the longitudinal axis of handle 205 can be chosen such that the handle provides a safe, ergonomic way to control the handle, or handles, if two are used, and thereby, weight bar 1. For example, in one embodiment, the length l can be between about 4 inches and about 8 inches; in a preferred embodiment, the length l is about 6 inches, which places the handle member 205 forward of the chest for an average-sized human. It has been found that this distance provides a safe, ergonomic gripping position of handle member 205 while performing squats, for example.

Referring now to FIG. 11, lift-assist device 200 is illustrated in practice by a weightlifter. In this illustration, lift-assist device 200 is secured to weight bar 1 by clamp member 210. Armature 215 is of sufficient length so as to allow the weightlifter to grasp handle member 205 in a safe, ergonomic manner, where the practitioner's elbows are positioned in and forward, the hands can face forward or rearward as desired, the shoulders are in a natural, unstressed position, and the angle between the upper arm and forearm (e.g., between the humerus and radius/ulna) is maintained at an angle sufficient to minimize hyperextension of the muscles and ligaments thereof. In this and other embodiments, armature 215 can include one or more of a cushion, padding or recess configured to reduce discomfort of bearing the weight of weight bar 1 (and associated additional weights) on the shoulders.

A number of illustrative embodiments have been described. Nevertheless, it will be understood that various modifications may be made without departing from the spirit and scope of the various embodiments presented herein. For example, the dimensions of a lift-assist device as shown and described herein can be modified according to various use or other considerations. In particular, a lift-assist device can be configured with an optimal handle-to-bar separation ($l_{SEP}$) for a variety of target exercises, bar sizes, human physiologies, or other factors. The configuration of the V-shaped frameworks 112, 117 can be configured to accommodate any size weight bar or other piece of equipment used for lifting weights or performing similar exercises. All or portions of a lift-assist device can include surface texturing for enhanced gripping or coupling to a weight bar. It should be understood that, while the foregoing descriptions and examples reference engagement of lift device 100 with weight bar 1, lift-assist device 100 can also engage with any other type of bar, handle, or other similar structure that bears weight or has weight attached thereto. Accordingly, other embodiments are within the scope of the following claims.

What is claimed is:

1. A barbell-stabilizing lift-assist device, comprising:

a substantially U-shaped handle portion having left and right sides, and a cylindrical gripping member disposed between said left and right sides configured to be gripped by a hand;

an arcuate, elongate armature having a proximal end portion integral with said substantially U-shaped handle portion and a distal end portion comprising a semicircle-shaped recess;

a semicircle-shaped clamping member pivotally coupled to said distal end portion of said armature that is shiftable between open and closed configurations; and a lever-actuated locking member comprising a latch member disposed on said semicircle-shaped clamping member that is configured to engage one of a plurality of latch recesses on a terminal end portion of said elongate armature;

wherein said clamping member and said semicircle-shaped recess of said armature cooperatively form a circular aperture configured to frictionally engage a barbell portion when said clamping member is in said closed configuration such that said barbell-stabilizing lift-assist device is reversibly locked in position on said barbell portion;

wherein a middle portion of said armature is configured to rest upon a user's shoulder, providing a barbell-stabilizing configuration wherein said handle portion is forward of said user's shoulder and said distal end portion is rearward of said user's shoulder; and wherein said armature between said handle portion and said distal end portion has a width that is less than a width of said handle portion.

* * * * *